US006916018B2

(12) United States Patent
Graushar et al.

(10) Patent No.: US 6,916,018 B2
(45) **Date of Patent: *Jul. 12, 2005**

(54) APPARATUS AND METHOD OF DELIVERING SIGNATURES TO A BINDING LINE

(75) Inventors: William T. Graushar, Wauwatosa, WI (US); John C. Geres, West Allis, WI (US)

(73) Assignee: Quad/Graphics, Inc., Sussex, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/764,824

(22) Filed: Jan. 26, 2004

(65) Prior Publication Data

US 2004/0173956 A1 Sep. 9, 2004

Related U.S. Application Data

(60) Continuation of application No. 10/265,887, filed on Oct. 7, 2002, now Pat. No. 6,682,062, which is a continuation of application No. 09/880,560, filed on Jun. 13, 2001, now abandoned, which is a division of application No. 09/426,345, filed on Oct. 25, 1999, now Pat. No. 6,267,366.

(51) Int. Cl.[7] ..... B41F 13/58

(52) U.S. Cl. ..... 270/4; 270/58.08; 101/32

(58) Field of Search ..... 270/4, 1.01, 1.02, 270/58.05, 52.14, 52.16, 52.18, 52.19, 52.2, 52.21, 52.29, 58.01, 58.2, 1.1, 58.23, 58.08, 58.07, 54–55, 58.14, 57, 58.18; 101/232, 483; 412/4, 13, 19; 271/240, 243, 244

(56) References Cited

U.S. PATENT DOCUMENTS 2,251,943 A * 8/1941 Kleineberg ..... 270/52.29
3,002,746 A * 10/1961 Lloyd et al. ..... 270/58.29
3,130,966 A 4/1964 Hepp
3,809,385 A * 5/1974 Rana ..... 270/52.29
4,022,455 A 5/1977 Newsome et al.
4,121,818 A 10/1978 Riley et al.
4,149,711 A 4/1979 Jackson
4,177,979 A 12/1979 Orsinger
4,236,706 A 12/1980 Schlough
4,247,092 A 1/1981 Dwyer
4,395,031 A 7/1983 Gruber et al.
4,754,959 A 7/1988 Kobler et al.
4,789,147 A 12/1988 Berger et al.
4,903,600 A 2/1990 Long
4,974,823 A * 12/1990 Ishiguro et al. ..... 270/58.09
4,989,850 A 2/1991 Weller
5,005,815 A 4/1991 Auksi
5,100,116 A 3/1992 Graushar
5,102,110 A 4/1992 Reynolds
5,144,562 A 9/1992 Stikkelorum et al.
5,203,549 A 4/1993 Bryson, Sr. et al.
5,207,412 A 5/1993 Coons, Jr. et al.
5,216,442 A * 6/1993 Parks et al. ..... 346/134
5,346,196 A 9/1994 Nussbaum et al.
5,413,321 A 5/1995 Banks et al.
5,467,973 A 11/1995 Graushar et al.
5,595,379 A 1/1997 Hoang
5,634,633 A 6/1997 Graushar
5,678,813 A 10/1997 Usako et al.
5,806,842 A * 9/1998 Steinhilber et al. ..... 270/58.08
5,810,345 A 9/1998 Lethmann et al.
5,816,773 A 10/1998 Fehringer et al.

(Continued)

*Primary Examiner*—Eugene H. Eickholt
(74) *Attorney, Agent, or Firm*—Michael Best & Friedrich LLP

(57) ABSTRACT

An apparatus and method for delivering signatures to a binding line, the apparatus and method preferably comprising a printer feeder apparatus and method for providing personalized information in a variety of locations upon a selected one of a plurality of signatures types before the signatures are fed to the binding line.

8 Claims, 7 Drawing Sheets

U.S. PATENT DOCUMENTS 5,820,325 A 10/1998 Hartsoe
5,820,334 A * 10/1998 Darcy et al. ..... 414/798.1
5,921,538 A 7/1999 Schlough
5,988,620 A 11/1999 Graushar
6,019,047 A 2/2000 Klaas et al.
6,213,456 B1 4/2001 Hirano et al.
6,217,271 B1 4/2001 Latvakangas et al.
6,237,908 B1 5/2001 Chang et al.
6,257,566 B1 7/2001 Dooley
6,267,366 B1 * 7/2001 Graushar et al. ..... 270/1.02

* cited by examiner

APPARATUS AND METHOD OF DELIVERING SIGNATURES TO A BINDING LINE

RELATED APPLICATIONS

This application is a continuation of U.S. patent application Ser. No. 10/265,887, filed Oct. 7, 2002 now U.S. Pat. No. 6,682,062, which is a continuation of U.S. patent application Ser. No. 09/880,560, filed Jun. 13, 2001 now abandoned, which is a divisional of U.S. patent application Ser. No. 09/426,345, filed Oct. 25, 1999 now U.S. Pat. No. 6,267,366.

FIELD OF THE INVENTION

The present invention relates to an apparatus and method for delivering signatures to a binding line and, more particularly, to a printer feeder apparatus and method for selecting one of a plurality of signature types from multiple hopper feeders and delivering the signatures to the binding line.

BACKGROUND OF THE INVENTION

Binding systems and lines are well known in the printing industry for mass producing books such as booklets, magazines, catalogues, advertising brochures and the like. Typically, one or more sharply folded and generally pre-printed blanks or signatures are sequentially fed by a number of spaced signature feeders and gathered on a conveyor line or chain which travels past the signature feeders. The signatures are gathered into a book block and moved through one or more on-line printing stations to a stitching or binding station. The bound signatures are thereafter typically conveyed to a trimming station and a labeling station where mailing labels which are pre-printed or printed on-line are affixed. For reference to a typical binding system, see U.S. Pat. No. 5,100,116.

Binding systems generally employ computer controlled production. A computer controls how the individual editions of the books are tailored or customized. This flexibility is important in satisfying the demands of a particular market or geographical destination. For instance, it may be desirable to offer certain recipients of the books various features or selected advertising depending upon their locale, income or occupation. Likewise, it may be relevant to customize books contingent upon a recipient's previous buying history. In addition, flexibility of printing external signatures or covers is important to meet postal regulations and to qualify for postage discounts.

Signature feeders in particular have been developed which are able to customize individual signatures before the individual signature is fed to the binding line. See U.S. Pat. No. 5,100,116. This type of signature feeder, termed a printer feeder, includes a single signature hopper, for processing one type of signature through a printer then, feeding the individual signature of the one type to the binding line. In this arrangement, an individual signature of the type held in the hopper can be customized before it is fed to the binding line.

SUMMARY OF THE INVENTION

The present invention provides an improved signature delivery apparatus and method for use in cooperation with a binding line. Preferably, the signature delivery apparatus is a printer feeder including a plurality of hopper feeders so that multiple types of signatures can be conveyed through a single printer feeder using a single printer. Specifically, the printer feeder includes a plurality of hoppers with corresponding feeders. A signal from the computer of the binding line is communicated to the printer feeder to determine which of the signature types to feed to the binding line. Upon receipt of the signal, the appropriate hopper feeder is activated to deliver a single signature to the binding line. Optionally, the signatures are customized with indicia by a printer before they are transported to the binding line.

It is a feature of the present invention to provide an improved apparatus and method for delivering signatures to a binding line.

It is another feature of the present invention to provide an apparatus and method for providing a selected one of a plurality of signature types to a binding line.

It is another feature of the present invention to provide an apparatus and method for printing on a selected one of a plurality of signature types and feeding the signature to a binding line.

It is another feature of the present invention to provide an improved printer feeder for use in conjunction with a binding line.

It is another feature of the present invention to provide an apparatus and method for providing printed information upon a selected one of a plurality of signatures types before the signatures are fed to the binding line.

It is another feature of the present invention to provide a printer feeder for a binding line that can supply a selected one of a plurality of signature types to the binding line.

It is another feature of the present invention to provide a printer feeder that customizes signatures of a selected signature type wherein a single printer feeder is able to so customize a plurality of signature types.

It is another feature of the present invention to provide a printer feeder with multiple signature hopper feeders.

It is another feature of the present invention to provide a printer feeder having increased flexibility in feeding multiple signature types.

It is another feature of the present invention to provide a printer feeder with multiple signature hopper feeders housing differing signature types and a single printer for customizing individual signatures of each signature type.

Other features and advantages of the invention will become apparent to those of ordinary skill in the art upon review of the following detailed description, claims, and drawings.

Figure 1:
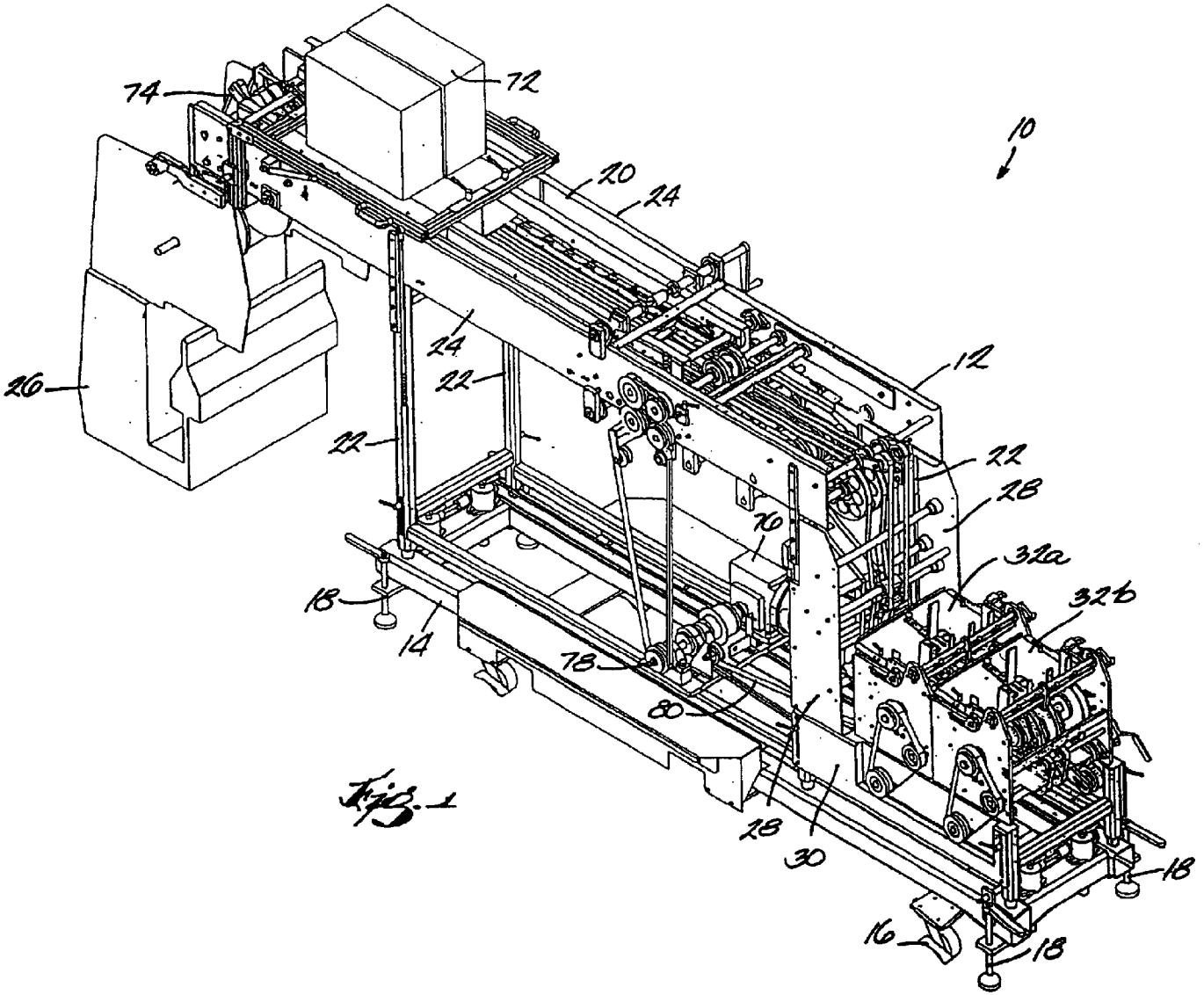
FIG. 1 is a perspective view of a printer feeder embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and example and should not be regarded as limiting.

DETAILED DESCRIPTION OF THE PREFERRED EMBODIMENT

Referring to FIG. 1, an apparatus for delivering signatures to a binding line is shown. The apparatus preferably is a printer feeder 10. The printer feeder 10 is designed to be used in conjunction with a binding line, such as the binding line shown and described in U.S. Pat. No. 5,100,116, to produce books such as catalogues, magazines, brochures, periodicals, and the like. Typically, the books contain different collections of signatures for different recipients, customers or subscribers. The printer feeder 10 of the present invention replaces a signature feeder on a binding line. The printer feeder 10 may be used to replace one or more signature feeders which can be removed from the binding line when more flexibility is required. Alternatively, the printer feeder 10 may be added to a line of existing signature feeders at a desired point. It should be noted that the binding line can be of various configurations and can be a saddle stitch binding line, a perfect binding line or the like.

Figure 2:
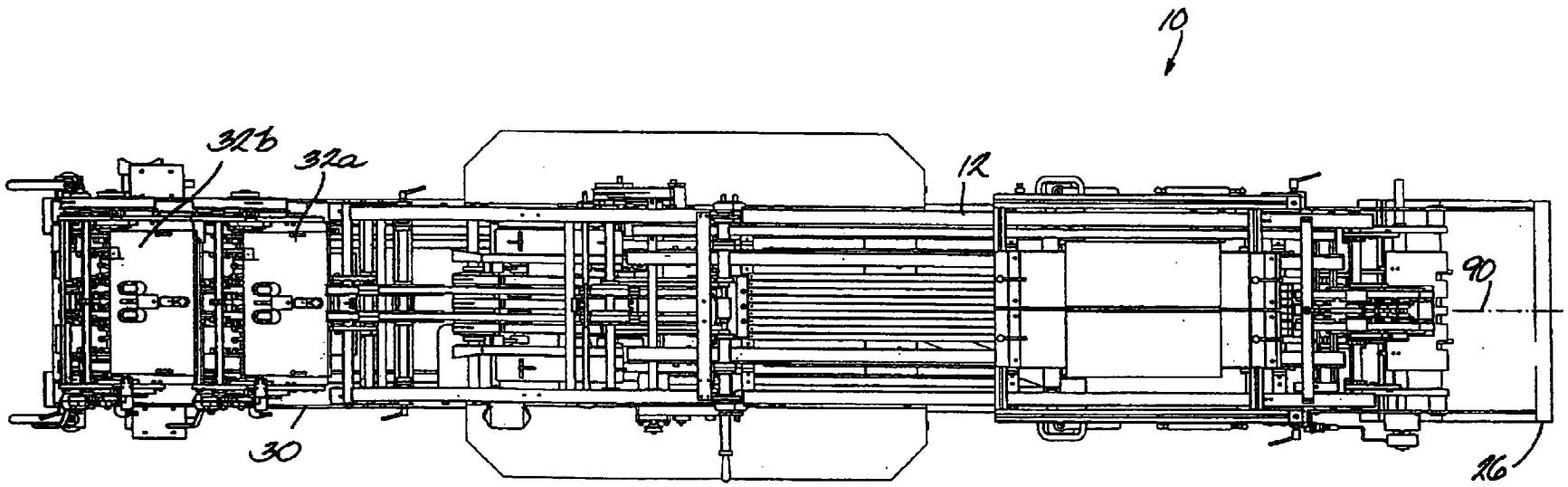
FIG. 2 is a top view of the printer feeder.
Figure 3:
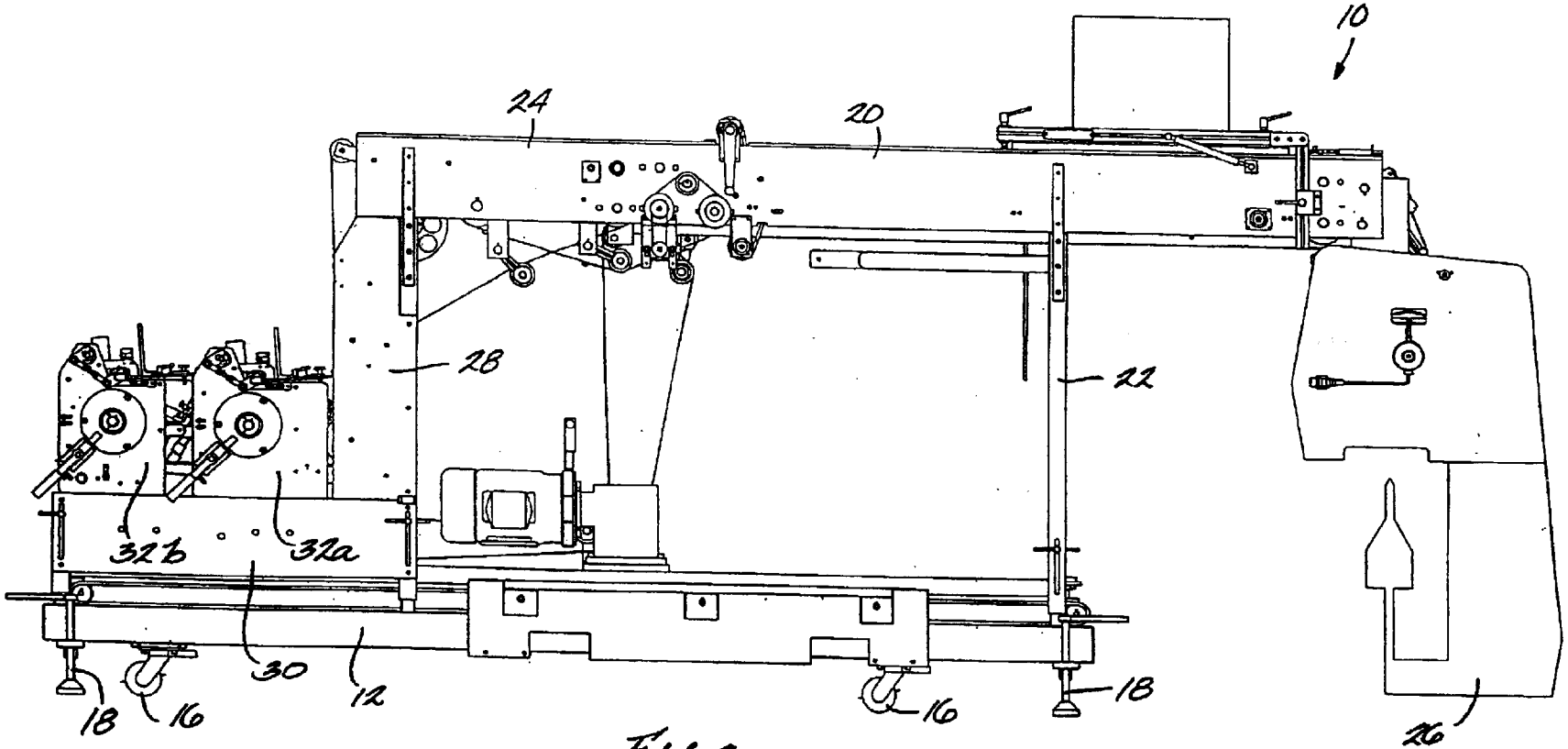
FIG. 3 is a side elevational view of the printer feeder.

Referring to FIGS. 1–3, the printer feeder 10 includes a frame assembly 12. The frame assembly 12 includes a support frame 14 that is generally rectangular. The support frame 14 includes casters 16 for easy transport of the printer feeder 10 and legs 18 for leveling and stabilizing the printer feeder 10 at a desired location. A second frame or print table 20 is oriented above the support frame 14 by the legs 22. A pair of side rails 24 extends from the print table 20. As particularly shown in FIGS. 1 and 3, the printer feeder 10 is shown in operational engagement with a host pocket 26 of a binding line. The host pocket 26 shown is produced by Muller Martini of Switzerland, however, the printer feeder 10 can be adapted to be operational with host pockets from other manufacturers such as, for example, Heidelberg or Sitma. The print table 20 and the side rails 24 are secured to the host pocket 26.

A support rail 28 extends downwardly from each side rail 24 and is connected to a hopper frame 30. The hopper frame 30 is supported by the support frame 14. Preferably, the print table 20 is positioned at a height above the hopper frame 30. However, it should be noted that the hopper frame 30 may be at the same or an elevated height relative to the print table 20. The hopper frame 30 supports a plurality of hopper feeder assemblies 32. Two hopper feeder assemblies 32*a* and 32*b* are shown in the figures, however, it should be noted that more than two hopper feeder assemblies 32 is contemplated and can be employed with the present invention.

Figure 4:
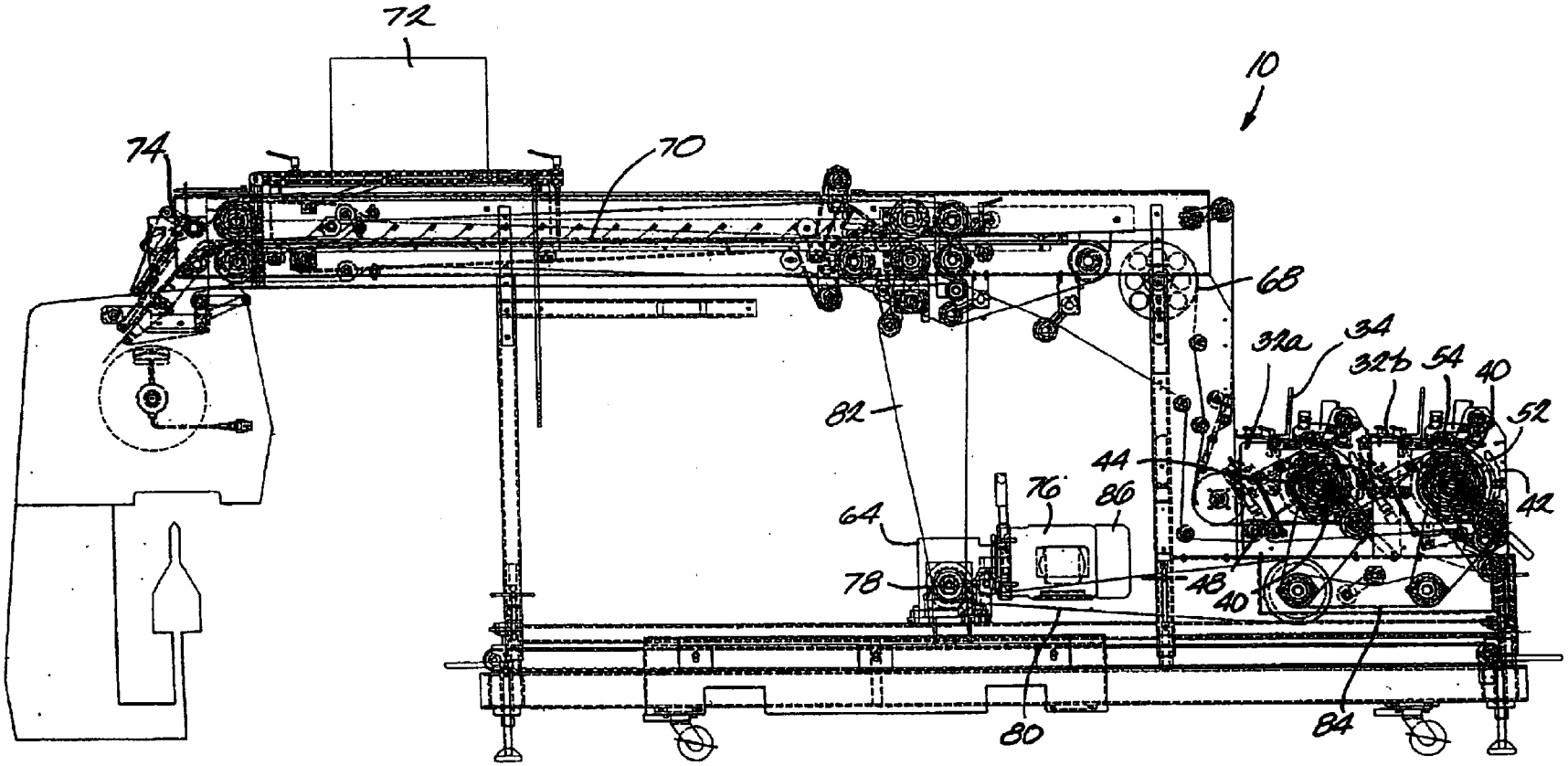
FIG. 4 is a sectional view of the printer feeder.
Figure 5:
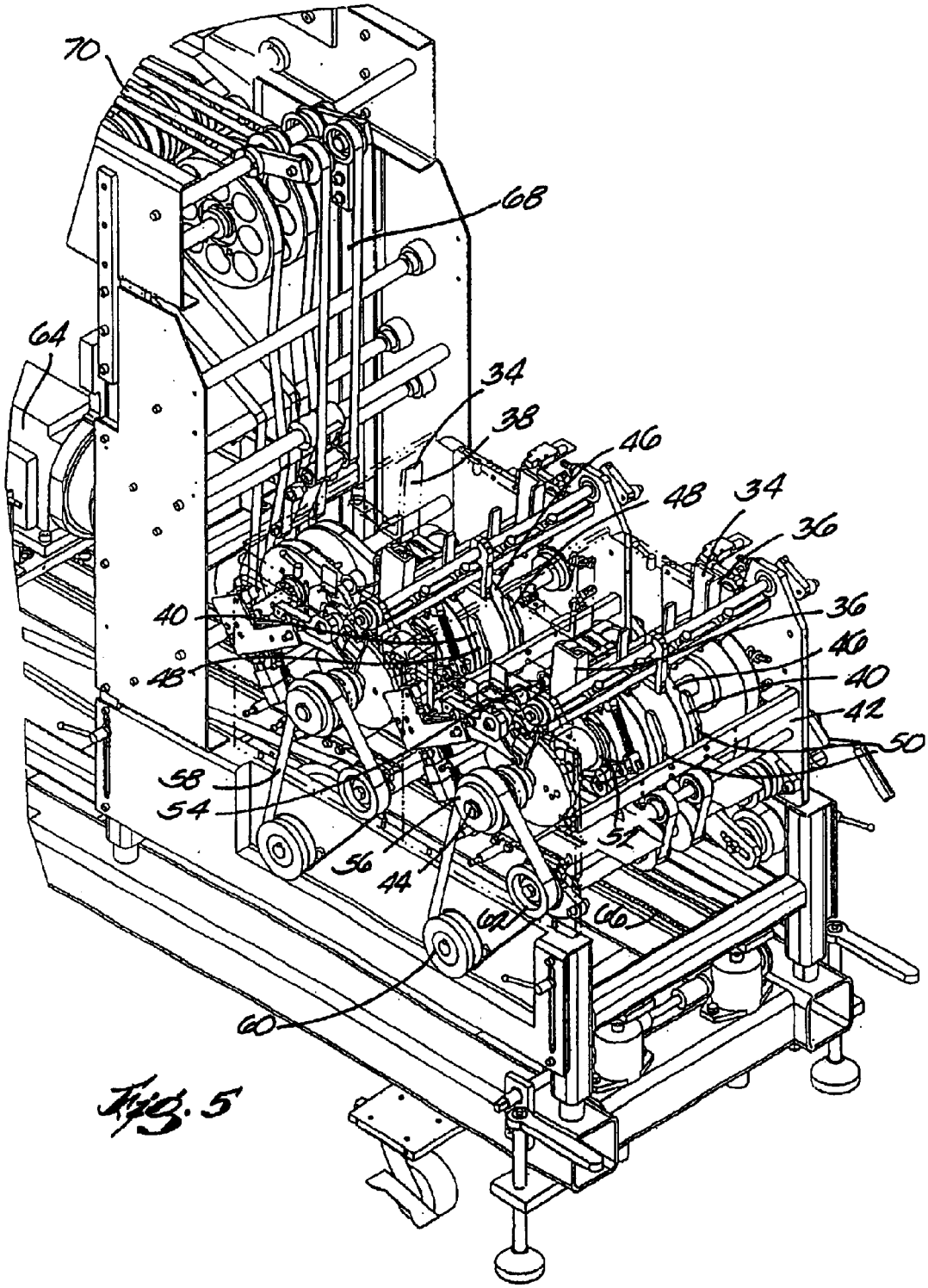
FIG. 5 is a perspective view of a hopper feeder portion of the printer feeder.
Figure 6:
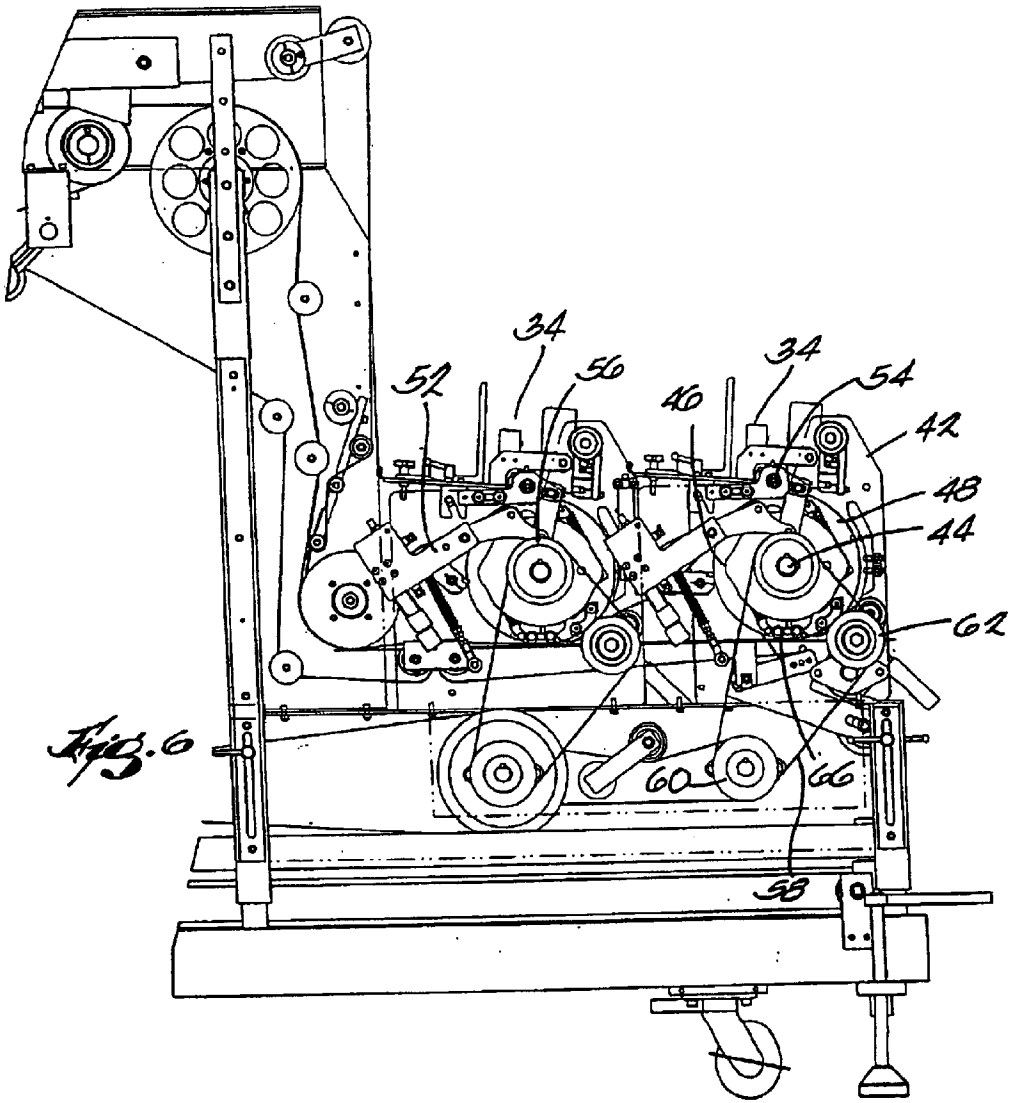
FIG. 6 is a side elevational view of the hopper feeder portion of the printer feeder.

Referring now to FIGS. 4–6, the hopper feeder assemblies 32 are best shown. As shown, the hopper feeder assemblies 32 are identical and therefore only one will be hereafter described. However, it should be noted that the hopper feeder assemblies 32 do not have to be identical. If desired, the assemblies 32 may vary from one to the other.

The hopper feeder assembly 32 includes a supply hopper 34 for supporting a stack of one type of signature. The supply hopper 34 includes a pair of corner guides 36 and a plurality of side guides 38, all for supporting and aligning the signatures in the stack. Preferably, the corner guides 36 contain the corners of the signatures adjacent the spine. The supply hopper 34 is in operational engagement with a feeding mechanism, often referred to as an auxiliary feeder 40. Auxiliary feeders are well known in the art and a conventional auxiliary feeders, such as that shown and described in U.S. Pat. No. 5,100,116 which is herein incorporated by reference, can be utilized in the printer feeder 10. Accordingly, the structure and function of the auxiliary feeder will only be generally described hereafter.

The feeder 40 as shown in FIGS. 4 and 5 includes a frame 42. A shaft 44 is supported for rotation by the frame 42. A pickup drum 46 is mounted for rotation on the shaft 44. Preferably, the pickup drum 46 includes a pair of spaced discs 48 having thereon grippers 50. A cam system 52 is also mounted on the shaft 44 and controls the selective opening and closing of the grippers 50. A feed assembly 54 indexes the signatures in the supply hopper 34.

The end of the shaft 44 carries a sprocket 56 driven by a belt 58. The belt 58 is entrained about the sprocket 56 and two lower idler sprockets 60, 62. The sprocket is driven by a drive mechanism 64 which will be later described. Clockwise rotation of the shaft (with reference to FIGS. 4 and 5) will cause the feeding assembly 54 to selectively extract the bottom most signature in the stack with the grippers 50 closing to rotate the extracted signature from the supply hopper 34 via the pickup drum 46. Once the pick up drum 46 has rotated also clockwise approximately 180 degrees, the cam system 52 effects the opening of the grippers 50 to release or drop the extracted signature onto a conveyor assembly 66, preferably in a spine leading orientation.

As shown in the drawings, all of the hopper feeder assemblies 32 are positioned above the conveyor assembly 66 so that each of the signatures extracted from the supply hoppers 34 drop onto the common conveyor assembly 66. The conveyor assembly 66 can be any type of conveyor such as a conventional belt conveyor which transfers individual signatures in a generally horizontal orientation to the support rails 28. It should be noted that alternatively, each hopper feeder assembly 32 could have its own adjacent conveyor, with the individual conveyors converging at a common point. A second conveyor assembly 68 thereafter picks up the signatures from the first conveyor assembly 66 and transports them generally vertically upwardly to the level of the print table 20. The second conveyor assembly 68 can be any type of conveyor such as a conventional belt type conveyor. The hopper feeder assemblies 32 are at a lower elevation than the print table 20 so that the supply hoppers 34 can be more easily loaded with signatures.

Referring now to FIGS. 1 and 4, a third conveyor assembly 70 picks up the individual signatures from the second conveyor assembly 68 and transports them generally horizontally to the host pocket 26. The third conveyor assembly 70 can be any type of conveyor such as a conventional belt conveyor. A printing mechanism such as printer 72 is positioned above and supported by the print table 20. The printer 72 optionally includes a registration station to register the signatures prior to printing. Such a printer 72 and registration system is shown and described in U.S. Pat. No. 5,100,116, which is herein incorporated by reference. Although not shown, the invention also contemplates the use of a second printer, either in place of or in addition to the first printer, below the level of the print table 20 which prints onto individual signatures from below the level of the print table 20.

The printer 72 prints indicia and/or customized indicia upon the individual signatures selectively fed from one of the hopper feed assemblies 32. The printer 72 is preferably a bank of conventional ink jet print heads although other types of printing mechanisms can also be utilized. The printer 72 enables a signature selectively routed and particularly oriented upon the conveyor assembly 78 to be processed with a personalized or tailored message printed anywhere on the exposed surfaces of signature, such as with the printed indicia oriented generally transverse to the leading edge of the signature. Such printing, of the right reading type, results in customized printing being presented within a book so that it can be easily read without having to turn the book or the reader's head. However, it should be noted that the indicia can be printed in any desired orientation on the signatures.

Continuing to refer to FIGS. 1 and 4, from the printer 72, the signatures are transported by the conveyor assembly 70 to a primary feeder 74 which is adjacent to and in operational engagement with the host pocket 26. The primary feeder 74 used with the present invention is a conventional feeder, such as the primary feeder shown and described in U.S. Pat. No. 5,110,116, which is incorporated herein by reference. The primary feeder 74 transfers the individual signatures from the conveyor assembly 70 to the binding line via the host pocket 26.

The printer feeder 10 includes the drive system 64 to operate the conveyor assemblies 66, 68 and 70 and the hopper feeder assemblies 32. The drive system 64 includes a motor assembly 76 which drives a shaft 78. A belt and pulley arrangement 80 transfers the rotational motion of the shaft to conveyor assembly 66. A belt and pulley arrangement 82 transfers the rotational motion of the shaft 78 to the conveyor assembly 70. A belt and pulley arrangement 84 transfers rotational motion from the conveyor assembly 66 to each hopper feed assembly 32. Alternatively, the belt and pulley arrangements could be replaced with motors, such as servo motors.

More specifically, the motor assembly 76 includes a conventional speed following motor 86 that is synchronized to the speed of the binding line using an encoder arrangement that is conventional in this art.

Each of the hopper feeder assemblies 32*a* and 32*b* is in communication with the controller on the binding line, such as the conventional programmable controller shown and described in U.S. Pat. No. 5,100,116. The controller controls which and when the hopper feeder assemblies 32 are fired. For example, the controller can send a signal to enable or disable the feeding of a signature, i.e., to trigger the release of a signature from a particular hopper feeder assembly. However, it should be noted that the control of which hopper feeder assembly to be triggered can be accomplished in other ways. The controller of the binding line also oversees sending printing instructions to the printer 72.

Figure 7:
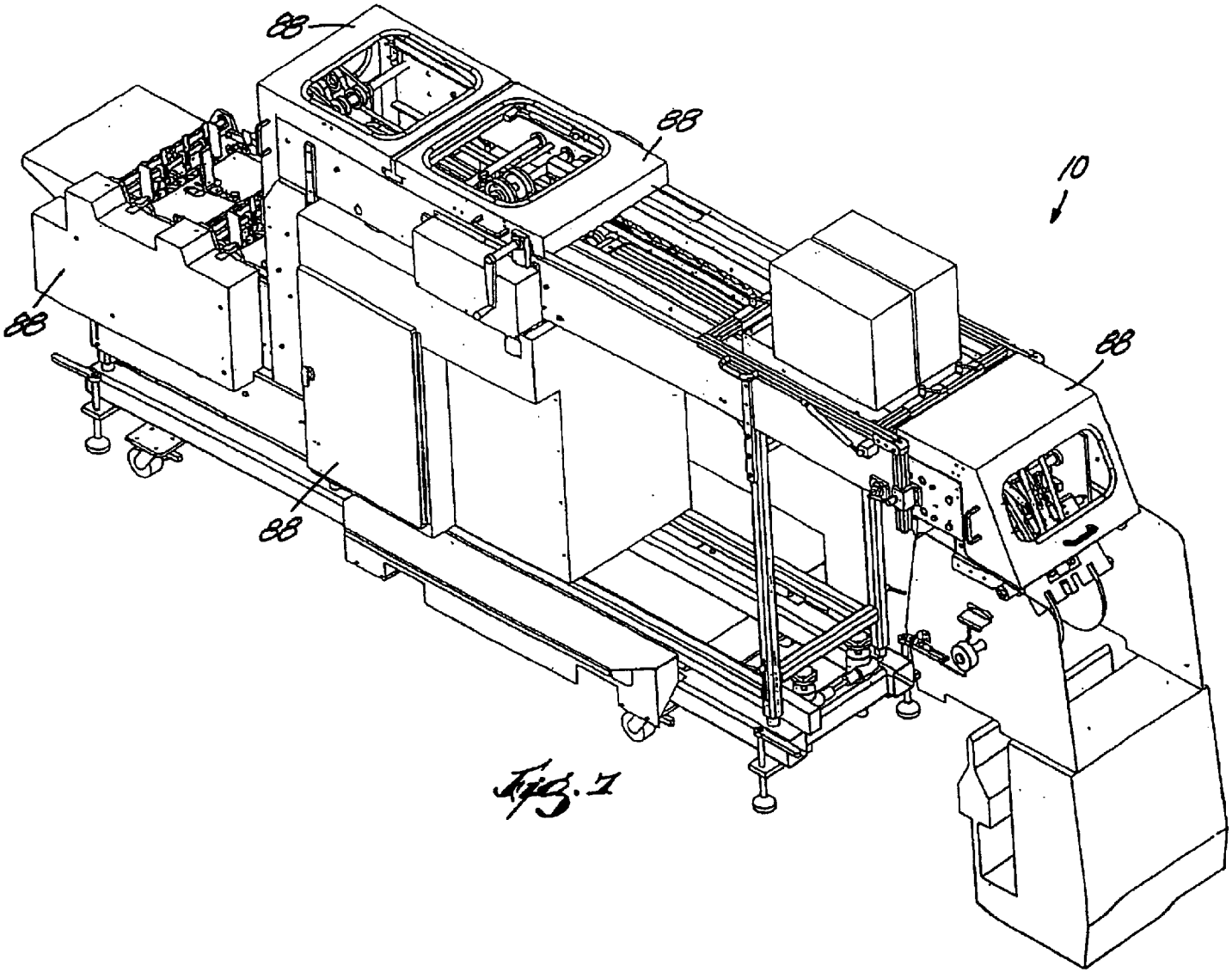
FIG. 7 is a perspective view of the printer feeder.

Referring now to FIG. 7, the printer feeder 10 is shown with shields 88 to protect the moving parts of the printer feeder 10 and to protect the printer feeder operator.

In operation, the printer feeder 10 is suitably positioned on a binding line. A stack of signatures of one type is loaded into the supply hopper 34 of one of the hopper feeder assemblies 32*a* and a stack of signatures of a second type is loaded into the supply hopper 34 of the other hopper feeder assembly 32*b*. The motor 86 is synchronized to the binding line via the encoder arrangement and the controller of the binding line is in communication with each of the hopper feeder assemblies 32. When a signature of one of the two types loaded into the printer feeder 10 is to be gathered on the binding line, the controller of the binding line sends a signal to appropriate hopper feeder assemblies 32 which thereafter deposits an individual signature onto the conveyor assembly 66. The signature is conveyed by the conveyor assembly 66, the conveyor assembly 68 and the conveyor assembly 70 to the printer 72 where the controller of the binding line instructs the printer 72 to print appropriate indicia, such as customized information, onto the individual signature. The signature is then transferred to the primary feeder 74 where is it deposited onto the binding line. As best shown in FIG. 2, the components of the printer feeder 10 are axially aligned such that the extracted signatures follow a generally straight path along line 90 to the binding line.

Accordingly, the printer feeder 10 of the present invention has the ability to select multiple types of signatures, print on that selected signature, then deliver the signature to the binding line. The invention is advantageous in that instead of two printer feeders to deliver two types of signatures to a binding line, one printer feeder 10 can perform the same function. It should be noted that this is a significant cost savings in that only one printer 72 is required instead of two.

As set forth above, the invention envisions a plurality of hopper feeder assemblies 32 per printer feeder 10 being utilized depending upon the requirements of the binding job being processed, and is not limited to the two hopper feeder assemblies 32*a* and 32*b* shown in the drawings. The invention also envisions the hopper feeder assemblies 32 being modular in that one printer feeder frame could accommodate, for example, one to five hopper feed assemblies, with the assemblies being added to and removed from the hopper frame as needed.

The invention can also be used to process multiple types of signatures without the use of the printer 72 to customize the individual signatures.

Accordingly, the foregoing description is meant to be of the preferred embodiments of the invention and exemplary only and should therefore not be deemed limitative on the scope of the invention set forth in the following claims.

We claim:

1. An apparatus for delivering signatures to a finishing line, the apparatus comprising:

a frame;

a pair of hoppers supported by the frame, each hopper adapted to hold a stack of signatures;

a first feeder supported by the frame and adapted to extract one signature from the stack of signatures in the first hopper;

a second feeder supported by the frame and adapted to extract one signature from the stack of signatures in the second hopper;

a printer supported by the frame and adapted to print on the extracted signature from either the first or second hopper; and a conveyor supported by the frame and adapted to transport the printed extracted signatures to the finishing line.

2. The apparatus of claim 1 wherein each hopper holds the stack of signatures in a horizontal orientation.

3. The apparatus of claim 1 wherein the first and second feeders include a pickup drum.

4. The apparatus of claim 1 wherein the printer includes an ink jet printer.

5. A printer feeder for use with a finishing line comprising:

a frame;

a plurality of hopper feeders supported by the frame, each of the hopper feeders including a hopper to hold a stack of signatures and a feeder adapted to extract one signature from the respective stack of signatures;

a printer supported by the frame, the printer adapted to print on the extracted signatures; and a conveyor supported by the frame and adapted to transport the extracted printed signatures from the printer to the finishing line.

6. The printer feeder of claim 5 wherein the printer includes an ink jet printer.

7. The printer feeder of claim 5 wherein the plurality of hopper feeders is two hopper feeders.

8. The printer feeder of claim 5 and further including a controller programmed to selectively operate the hopper feeders.

* * * * *